US006956458B2

(12) United States Patent
Lenk et al.

(10) Patent No.: US 6,956,458 B2
(45) Date of Patent: Oct. 18, 2005

(54) ARRESTER DISCONNECTOR ASSEMBLY HAVING A CAPACITOR

(75) Inventors: Dennis W. Lenk, Medina, OH (US); Xingniu Huo, Medina, OH (US); John A. Krause, Medina, OH (US); Craig S. Hunsicker, Wadsworth, OH (US)

(73) Assignee: Hubbell Incorporated, Orange, CT (US)

( * ) Notice: Subject to any disclaimer, the term of this patent is extended or adjusted under 35 U.S.C. 154(b) by 31 days.

(21) Appl. No.: 10/978,465

(22) Filed: Nov. 2, 2004

(65) Prior Publication Data

US 2005/0088795 A1 Apr. 28, 2005

Related U.S. Application Data

(62) Division of application No. 10/447,282, filed on May 29, 2003, now Pat. No. 6,876,289.

(51) Int. Cl.[7] ..... H01H 39/00; H01T 4/02

(52) U.S. Cl. ..... 337/30; 337/28; 361/117; 361/123

(58) Field of Search ..... 337/18, 28–34; 361/117–138; 338/21

(56) References Cited

U.S. PATENT DOCUMENTS

| | | | | |
|---|---|---|---|---|
| 3,611,044 A | * | 10/1971 | Osterhout et al. | 361/128 |
| 3,679,938 A | | 7/1972 | Carothers et al. | |
| 3,859,569 A | * | 1/1975 | Kresge | 361/128 |
| 3,869,650 A | | 3/1975 | Cummingham et al. | |
| 3,875,466 A | * | 4/1975 | Jakszt | 361/120 |
| 4,002,947 A | * | 1/1977 | Holtzman | 361/16 |
| 4,174,530 A | * | 11/1979 | Kresge et al. | 361/127 |
| 4,204,238 A | | 5/1980 | Stetson | |
| 4,326,233 A | * | 4/1982 | Yanabu et al. | 361/127 |
| 4,471,402 A | | 9/1984 | Cunningham | |
| 4,486,805 A | * | 12/1984 | Cline | 361/133 |
| 4,609,902 A | | 9/1986 | Lenk | |
| 4,734,823 A | | 3/1988 | Cunningham | |
| 4,930,039 A | * | 5/1990 | Woodworth et al. | 361/127 |
| 5,057,810 A | | 10/1991 | Raudabaugh | |
| 5,113,167 A | | 5/1992 | Raudabaugh | |
| 5,434,550 A | | 7/1995 | Putt | |
| 5,680,289 A | * | 10/1997 | Robinson et al. | 361/127 |
| 5,923,518 A | * | 7/1999 | Hensley | 361/117 |
| 5,952,910 A | | 9/1999 | Krause | |
| 6,657,842 B2 | * | 12/2003 | Krause | 361/117 |

FOREIGN PATENT DOCUMENTS

| | | | | |
|---|---|---|---|---|
| EP | 19884 A1 | * | 12/1980 | H02H 3/04 |
| JP | 63294218 A | * | 11/1988 | H02H 9/06 |

* cited by examiner

*Primary Examiner*—Anatoly Vortman
(74) *Attorney, Agent, or Firm*—Marcus R. Mickney; Alfred N. Goodman; Mark S. Bicks

(57) ABSTRACT

A disconnector assembly is provided for an arrester. A non-conductive housing has first and second opposite ends separated by an internal chamber. A first electrical terminal is connected at the first end. A second electrical terminal is connected at the second end. A capacitor engages and extends between the first and second terminals in the internal chamber. A sparkgap is electrically parallel the capacitor between the first and second terminals. A cartridge with an explosive charge is positioned in the internal chamber, and the cartridge is electrically parallel the capacitor and electrically in series with the sparkgap.

6 Claims, 3 Drawing Sheets

ARRESTER DISCONNECTOR ASSEMBLY HAVING A CAPACITOR

REFERENCE TO PRIOR NOVPROVISIONAL APPLICATION

This application is a divisional application of U.S. patent application Ser. No. 10/447,282, filed May 29, 2003 now U.S. Pat. No. 6,876,289, which is hereby incorporated by reference in its entirety.

FIELD OF THE INVENTION

The present invention relates to a disconnector assembly for an arrester. The arrester is isolated upon arrester failure. More particularly, the present invention relates to a pair of electrical terminals coupled by a capacitor assembly, a sparkgap and an explosive cartridge. The capacitor assembly includes a capacitor, and is electrically parallel the sparkgap.

BACKGROUND OF THE INVENTION

Lighting or surge arresters are typically connected to power lines to carry electrical surge currents to ground, thereby preventing damage to lines and equipment connected to the arresters. Arresters offer high resistance to normal voltage across power lines, but offer very low resistance to surge currents produced by sudden high voltage conditions caused by, for example, lighting strikes, switching surge currents or temporary overvoltages. After the surge, the voltage drops and the arrester normally returns to a high resistance state. However, upon arrester malfunction or failure, the high resistance state is not resumed, and the arrester continues to provide an electrical path from the power line to ground. Ultimately, the line will fail due to a short circuit condition or breakdown of the distribution transformers, and the arrester will require replacement.

To avoid line lockout, disconnector assemblies are commonly used in conjunction with arresters to separate a malfunctioning arrester from the circuit and to provide a visual indication of arrester failure. Conventional disconnector assemblies have an explosive charge to destroy the circuit path and physically separate the electrical terminals. Examples of such disconnector assemblies are disclosed in U.S. Pat. No. 5,952,910 to Krause and U.S. Pat. Nos. 5,057,810 and 5,113,167 to Raudabaugh, as well as U.S. Pat. No. 5,434,550 to Putt, U.S. Pat. No. 4,471,402 to Cunningham and U.S. Pat. No. 4,609,902 to Lenk, the subject matter of each of which are hereby incorporated by reference.

Traditionally, polymer-housed distribution class arresters are assembled with a ground end insulating bracket that physically supports the arrester, as well as isolating the ground end of the arrester from the system ground in the event of arrester service failure. A ground lead connector, or isolator, connects the ground end of the isolator to the system neutral or ground wire.

In normal service conditions, the arrester grading current flows through the ground lead isolator. If the arrester fails, the arrester 60 Hz fault current flows through the failed arrester and through the ground lead disconnector, which causes the ground lead disconnector to operate. The disconnector disconnects from ground, thereby effectively isolating the failed arrester from ground. Separating the arrester from ground allows the utility to provide uninterrupted service to its customers. This also facilitates identifying the failed arrester so that it may be replaced with a new arrester.

Existing disconnectors typically have a grading component in parallel with a sparkgap. The grading component and sparkgap are located close to a detonating device, such as an unprimed cartridge. The grading component conducts the arrester grading current under normal service conditions. If arrester failure occurs, the arrester grading current increases from a few milliamperes to amperes or thousands of amperes, depending on the utility system grounding at the arrester location. This high current flow causes voltage to develop across the disconnector grading component. When voltage reaches a predetermined level, the parallel sparkgap sparks over, thereby causing heat build-up on the cartridge. The cartridge then detonates and separates the ground lead connection.

Typically, the grading component is a low voltage precision resistor, a high power resistor, or a semi-conductive polymer material. However, these grading components tend to fail during prolonged temporary overvoltage situations. Failure of the grading components can prevent disconnectors from properly detonating. A need exists for a disconnector providing a more reliable cartridge detonation.

Furthermore, existing grading components are often significantly damaged during durability testing, which results in deterioration of the electrical integrity of the disconnector. A deteriorated grading component may result in a degraded time-current deterioration characteristic. A need exists for a grading component that is not significantly deteriorated by durability testing.

A need exists for an improved disconnector assembly for an arrester.

SUMMARY OF THE INVENTION

Accordingly, it is a primary objective of the present invention to provide an improved disconnector assembly.

A further objective of the present invention is to provide a disconnector assembly for an arrester that provides a more reliable cartridge detonation.

A still further objective of the present invention is to provide a disconnector assembly for an arrester having a grading component that is not significantly deteriorated by durability testing.

The foregoing objects are basically attained by providing a disconnector assembly for an arrester. A non-conductive housing has first and second opposite ends separated by an internal chamber. A first electrical terminal is connected at the first end. A second electrical terminal is connected at the second end. A capacitor assembly engages and extends between the first and second terminals in the internal chamber. A sparkgap is electrically parallel to the capacitor assembly between the first and second terminals. A cartridge with an explosive charge is positioned in the internal chamber, the cartridge being electrically parallel to the capacitor and electrically in series with the sparkgap.

In another embodiment, the foregoing objects are basically attained by providing a disconnector assembly for an arrester. A non-conductive housing has first and second opposite ends separated by an internal chamber. A first electrical terminal is connected at the first end. A second electrical terminal is connected at the second end. A capacitor assembly engages and extends between the first and second terminals in the internal chamber. The capacitor assembly includes a capacitor and a resistor electrically connected in series. A sparkgap is electrically parallel to the capacitor assembly between the first and second terminals. A cartridge with an explosive charge is positioned in the internal chamber, the cartridge being electrically parallel to the capacitor assembly and electrically in series with the sparkgap. The capacitance characteristic of the capacitor allows the capacitor to withstand prolonged temporary overvoltage conditions that cause linear resistors to fail, thereby providing a more reliable disconnector assembly.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings that form a part of the original disclosure.

DETAILED DESCRIPTION OF THE INVENTION

Figure 1:
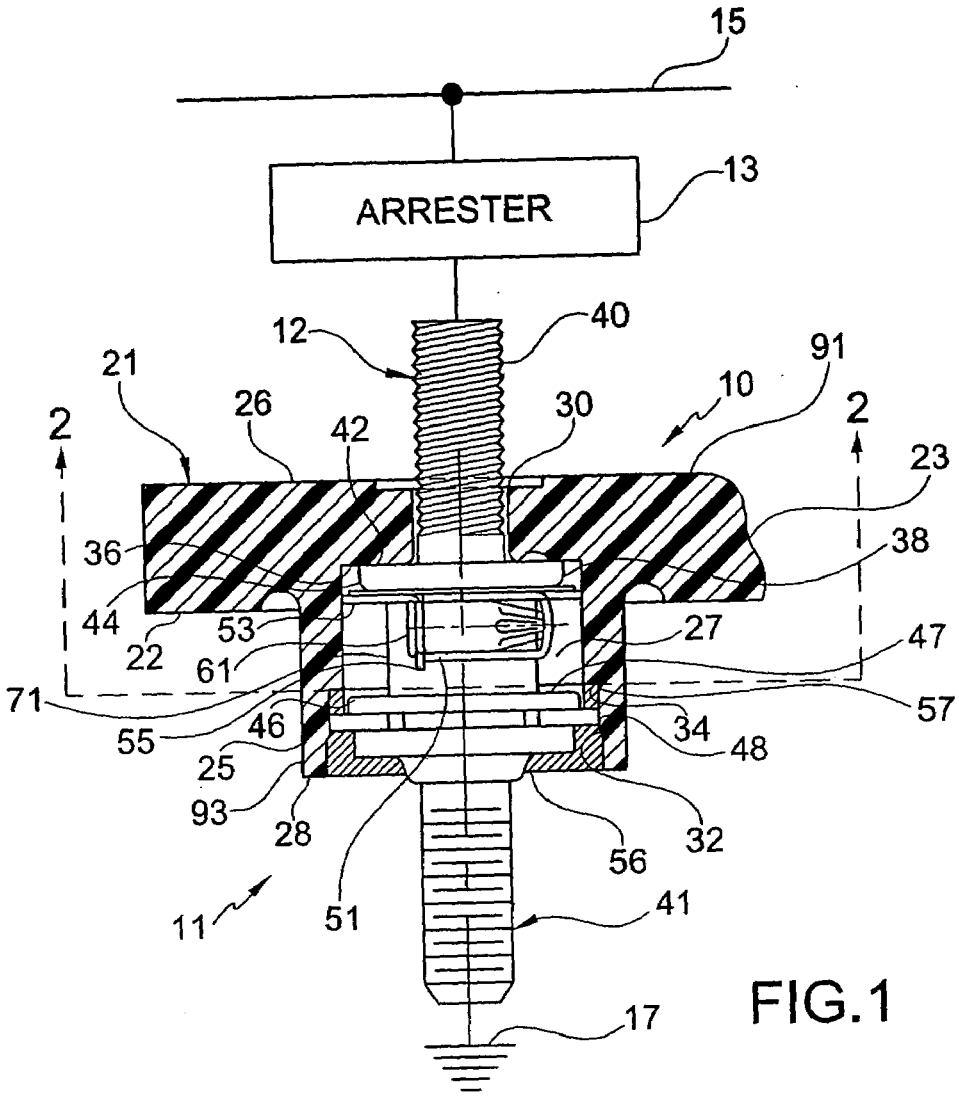
FIG. 1 is a side elevational view in partial cross section of a disconnector assembly according to the present invention.

As shown in FIGS. 1–4, the present invention relates to a disconnector assembly 10 for an arrester 13. A non-conductive housing 21 has first and second opposite ends 91 and 93 separated by an internal chamber 27. A first electrical terminal 12 is connected at the first end 91. A second electrical terminal 41 is connected at the second end 93. A capacitor assembly 95 engages and extends between the first and second terminals 12 and 41 in the internal chamber 27. The capacitor assembly included a capacitor 31 and a resistor 81 electrically connected in series. A cartridge 51 with an explosive charge is positioned in the internal chamber 27. The cartridge is electrically parallel to the capacitor assembly 95. A spring spacer 53 receives the cartridge 51. The spring spacer 53 is adjacent the first terminal 12 and spaced from the second terminal 41.

Figure 2:
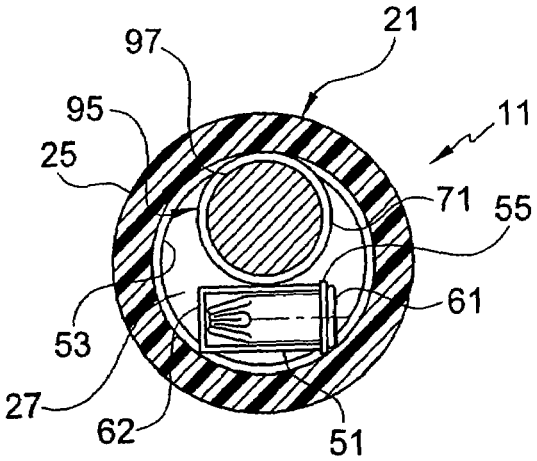
FIG. 2 is a bottom plan view in cross section taken along line 2—2 of FIG. 1 of the present invention.

Referring initially to FIGS. 1 and 2, a disconnector assembly 11, according to the present invention, comprises a first, upper electrical terminal 12 electrically connected to arrester 13, and a second, lower electrical terminal, or stud, 41 electrically connected to ground 17. Arrester 13 is electrically connected to power line 15, which is representative of a power system. Terminals 12 and 41 are mechanically and electrically coupled to each other.

Arrester 13 is conventional, and thus, is not described in detail. The arrester may be formed according to U.S. Pat. No. 4,656,555 to Raudabaugh, the subject matter of which is hereby incorporated by reference.

Terminals 12 and 41 are mechanically connected to one another by a bracket 21. Bracket 21 may be formed of any suitably strong insulating material, such as a non-conductive plastic. Preferably, the bracket is made of a glass filled polyester material. As noted above, the bracket 21 has a base 23 and a wall 25 extending substantially perpendicularly from base 23, with wall 25 defining an internal cavity 27 extending between surface 22 of base 23 and surface 28 of wall 25. The upper end of cavity 27 is connected to bracket surface 26 by cylindrical upper bore 30. The lower end of cavity 27 is connected to surface 28 of wall 25 by a stepped lower chamber 32. The transverse diameter of lower chamber 32 is greater than the transverse diameter of internal cavity 27.

Between cavity 27 and lower chamber 32, the bracket has a radially extending lower annular shoulder 34. An upper shoulder 36 extends radially at the interface of cavity 27 and upper bore 30.

Upper electrical terminal 12 is of conventional construction, and has a head portion 38 located within cavity 27 and abutting upper shoulder 36. An externally threaded shank portion 40 of terminal 12 extends from the head portion through upper bore 30, such that the shank portion is at least partially exposed exteriorly of bracket 21 for coupling to arrester 13. In this manner, head portion surface 42 engages upper shoulder 36, while head portion surface 44 is exposed in cavity 27.

An isolator assembly 11 is disposed in cavity 27. The isolator assembly may include a capacitor 31, a cartridge 51, and a spring spacer 53. The spring spacer 53 abuts surface 44 of terminal head portion 38. Spring spacer 53 provides a biasing force to maintain electrical or physical contact of the isolator assembly components within cavity 27, and facilitates electrically connecting upper terminal 12 to lower terminal (stud) 41. Tab 55 extends downwardly from the spring spacer 53 into the cavity 27 and receives cartridge 51.

Figure 4:
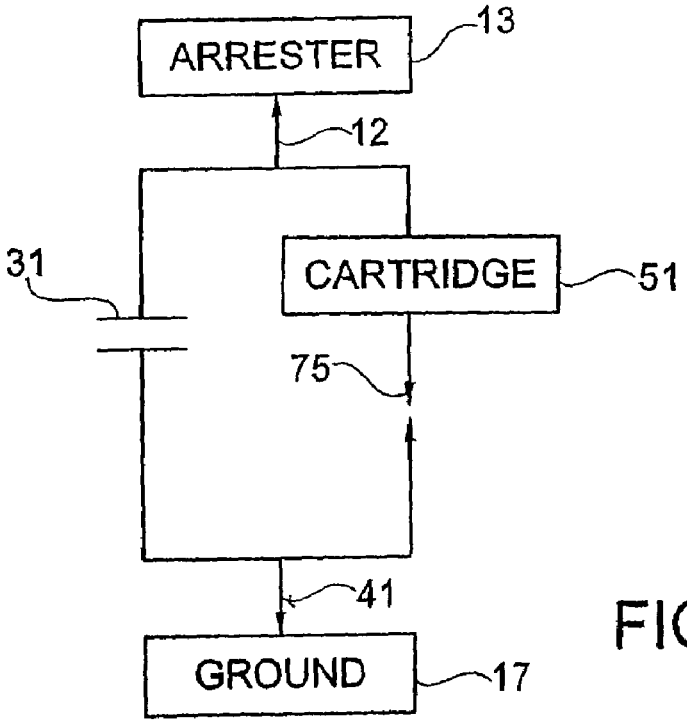
FIG. 4 is a schematic electrical diagram according to a second embodiment of the present invention showing the capacitor connected electrically parallel the sparkgap.
Figure 5:
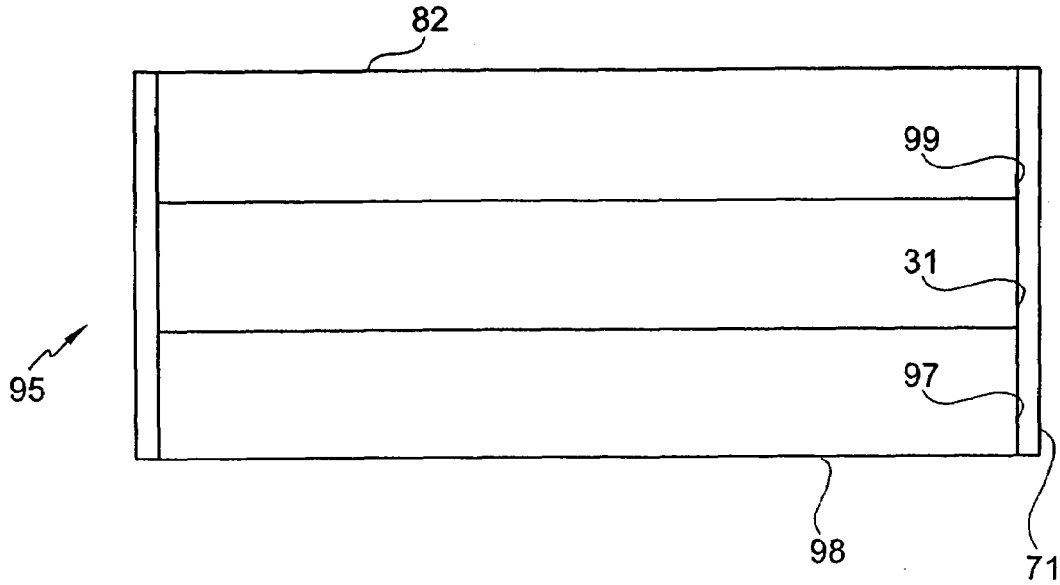
FIG. 5 is an elevational view of the capacitor assembly taken in cross section along a plane through the longitudinal axis of the capacitor assembly of the present invention.
Figure 6:
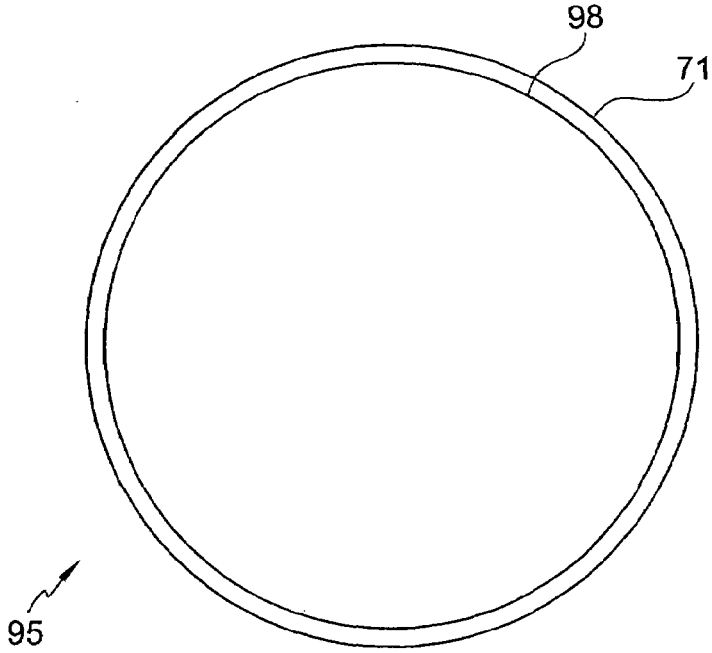
FIG. 6 is a bottom plan view of the capacitor assembly of FIG. 5.

Capacitor 31 is mounted in cavity 27 and extends between spring spacer 53 and upper surface 47 of cap 46, thereby providing an electrical connection between the upper and lower terminals 12 and 41 through conductive cap 46. FIG. 4 shows an electrical diagram of the isolator assembly 11 having a capacitor 31 between the arrester 13 and ground 17. Preferably, the capacitor is formed of a high voltage material, such as ceramic. Preferably, the capacitor 31 is encased in an insulative sleeve or ceramic collar 71 to protect the capacitor from carbon contamination during a gap sparkover that causes the cartridge 51 to discharge, as shown in FIG. 5. The capacitor assembly 95 includes the capacitor 31 and terminals 99 and 97 above and below the capacitor, respectively, within the insulative sleeve 71. The terminals 99 and 97 have conductive surfaces 82 and 98 (FIG. 6), respectively, to provide an electrical connection from the upper terminal 12 through the capacitor assembly 95 to the lower terminal 41. The insulating sleeve 71 may have an RTV type material oriented in the interface between the sleeve and the terminals 99 and 97 and the capacitor 31 to enhance the dielectric integrity of the interface.

The capacitance of the high-voltage capacitor 31 eliminates failure during periods of prolonged overvoltage conditions, which was a problem with the resistors. Failure of the resistors prevents proper detonation of the cartridge after an arrester has been exposed to a prolonged temporary overvoltage condition. Since the high-voltage capacitor 31 does not fail during the arrester overvoltage event it provides a more reliable cartridge detonation, thereby eliminating the nuisance associated with system lockouts experienced by utilities and their customers. The high-voltage capacitor 31 provides improved temporary overvoltage capabilities for the arrester during system overvoltage conditions than is available with resistors used alone in isolators, thereby eliminating capacitor failure and non-detonation of the cartridge. Thus, the high-voltage capacitor 31 improves temporary overvoltage capability for the arrester 13 under system overvoltage conditions.

The electrical and mechanical integrity of the high-voltage capacitor 31, in conjunction with the good dielectric integrity of the ceramic collar or insulative sleeve 71, prevents significant deterioration when the serially connected arrester is exposed to durability testing. Durability testing, such as 100 kA lightning impulse duty, does not significantly deteriorate the electrical integrity of the isolator assembly 11 having a high-voltage capacitor 31. Isolators using a resistor alone may be significantly damaged by this type of duty, resulting in deterioration of the electrical integrity of the disconnector assembly. Such damage includes a degraded time-current detonation characteristic, which results in an unreliable cartridge detonation.

The isolator assembly 11 having the high-voltage capacitor 31 detonates at a lower current level, typically around a few hundred milliamperes, than existing isolator assemblies using resistors, since the high-voltage capacitor has a high impedance. The high impedance allows sparkover of the sparkgap when the arrester 13 has only partially failed or fails in a high-impedance grounded or delta system configuration, thereby providing a more reliable cartridge 51 detonation and a more reliable isolator assembly 11.

Figure 3:
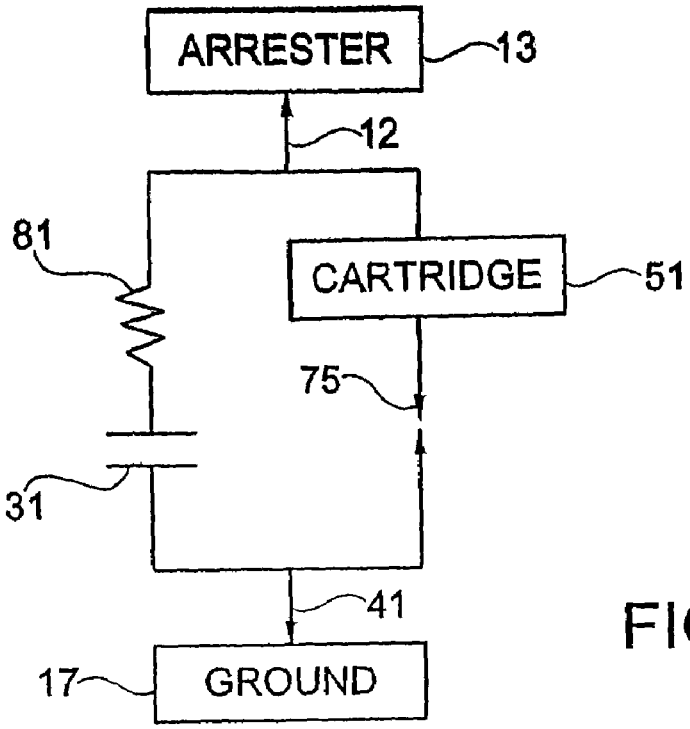
FIG. 3 is a schematic electrical diagram according to a first embodiment of the present invention showing the capacitor assembly connected electrically parallel the sparkgap.

In another preferred embodiment, a capacitor assembly 95 has a capacitor 31 connected electrically in series with a resistor 81, as shown in FIG. 3, to provide the electrical path between the arrester 13 and the ground 17. The resistor 81 improves the capability of the capacitor to withstand high frequency oscillations associated with the gap sparkover 75, thereby minimizing the probability of damaging the capacitor. Preferably, both the capacitor 31 and resistor 81 are housed in an insulative sleeve 71 to protect the capacitor from carbon contamination during a gap sparkover occurring during arrester operations.

Cartridge 51 with an explosive charge is mounted in cavity 27 adjacent capacitor 31. Cartridge 51 is elongated along a cartridge axis that is substantially perpendicular to the longitudinal axis of terminals 12 and 41 and of bracket cavity 27. Cartridge 51 receives the spring spacer tab 55 between its head 61 and body 62, as shown in FIG. 1, to secure the cartridge in cavity 27 proximal the spring spacer 53.

Second terminal, or lower terminal, 41 is a conventional stud. The second terminal 41 has a head portion, or cap, 46 and a threaded shank portion 64. Head portion 46 has an upper surface 47 facing into cavity 27 and abutting the housing lower shoulder 34. Terminal 41 is maintained in position in housing 21 by engagement of its head portion 46 with housing lower shoulder 34 and by a suitable adhesive 56, such as an epoxy.

An adhesive 56 between the shoulder 48 of head portion 46 and the wall 25 secures the second terminal within the housing 22. Any suitable adhesive may be used, but preferably the adhesive is a thick epoxy that has a fast curing time in air to avoid contaminating the disconnector assembly during the manufacturing process.

A gasket 57 is positioned between the upper surface of the shoulder 48 of the head portion 47 and the lower shoulder 34 of the cavity 27. The gasket further ensures adhesive 56 does not enter cavity 27, thereby possibly damaging any of the components of the disconnector assembly.

As illustrated in FIG. 1, a sparkgap 75, shown schematically in FIGS. 3 and 4, is provided between the head 61 of the cartridge 61 and the upper surface 27 of the lower terminal 41. The sparkgap 75 is connected electrically in parallel to the capacitor 31 between the first and second terminals 12 and 41, as shown in FIG. 4. In another embodiment shown in FIG. 3, the sparkgap 75 is connected electrically in parallel to the capacitor assembly 95. The cartridge 51 is connected electrically in series with the sparkgap 75, as shown in FIGS. 3 and 4, so that when the gap sparks over during arrester failure the cartridge detonates, thereby isolating the arrester 13 from ground 17.

ASSEMBLY AND DISASSEMBLY

A fully assembled disconnector assembly 11 is shown in FIGS. 1 and 2. Upper electrical terminal 12 is inserted through bore 30 to connect bracket 21 to an arrester 13. The isolator assembly 11 is then simply dropped into cavity 27 over terminal 12. Cavity 27 is then sealed by securing gasket 57 and lower terminal stud 41 to wall 25 of bracket 21 with adhesive 56. Disconnector assembly 11 is then completed by allowing the adhesive 56 to cure, thereby sealing the isolator assembly 11 in cavity 27.

During normal non-fault operation of the arrester 13, little or no current passes through isolator assembly 11 due to the high resistance of the arrester. When subjected to lighting or surge currents, the arrester discharges high pulse currents which travel through arrester 13 and isolator assembly 11. Within the isolator assembly, the current will arc over between the spring spacer 55 of the cartridge 51 and upper surface 47 of the lower terminal 41 and to ground 17.

When the arrester is properly functioning, the gaps spark over for high current, short duration pulses which last less than 100 milliseconds for lightening and less than several milliseconds for switching currents. For such short sparkovers, insufficient energy is generated to activate or denote the cartridge. However, if the lightening arrester fails to withstand the voltages, the arcs are generated over a sufficiently extended period to activate the unprimed cartridge, causing an explosion that separates the terminals 12 and 41 mechanically from one another. The force of the exploded charge forces at least one of the terminals, usually lower terminal 41, from the housing 21. This action electrically disconnects arrester 13 from the system, and provides a visual indication of the need for arrester replacement.

While advantageous embodiments have been chosen to illustrate the invention, it will be understood by those skilled in the art that various changes and modifications may be made therein without departing from the scope of the invention as defined in the appended claims.

What is claimed is:

1. An arrester assembly, comprising:

an arrester;

a non-conductive housing having first and second opposite ends separated by an internal chamber;

a first electrical terminal connected at said first end;

a spring spacer disposed adjacent said first electrical terminal and having a tab extending downwardly therefrom;

a second electrical terminal connected at said second end of said housing to ground;

a sleeve engaging and extending between said spring spacer and said second terminal in said internal chamber;

a high voltage capacitor disposed in said sleeve;

a sparkgap connected electrically parallel said capacitor; and a cartridge with an explosive charge positioned in said internal chamber and received by said tab, said cartridge being electrically parallel to said capacitor and electrically in series to said sparkgap.

2. An arrester assembly according to claim 1, wherein said capacitor is made of ceramic.

3. A disconnector assembly for an arrester according to claim 1, wherein an adhesive connects said second terminal to said housing.

4. A disconnector assembly for an arrester according to claim 3, wherein a gasket is positioned between said second terminal and said housing to prevent said adhesive from entering said internal chamber.

5. A disconnector assembly for an arrester according to claim 4, wherein an inner surface of said housing is stepped for receiving said gasket.

6. A disconnector assembly for an arrester according to claim 1, wherein said housing is made of a non-conductive plastic.

* * * * *